United States Patent [19]

Hayashi et al.

[11] Patent Number: 4,462,705

[45] Date of Patent: Jul. 31, 1984

[54] CROSS HAMMER DOT PRINTER

[75] Inventors: Mikio Hayashi; Seiki Mizutani, both of Tokyo, Japan

[73] Assignee: Seikosha Co., Ltd., Tokyo, Japan

[21] Appl. No.: 390,839

[22] Filed: Jun. 22, 1982

[30] Foreign Application Priority Data

Jun. 30, 1981 [JP] Japan ..... 56-102987

[51] Int. Cl.[3] ..... B41J 3/02

[52] U.S. Cl. ..... 400/121; 101/93.04; 400/657

[58] Field of Search ..... 400/121, 657; 101/93.04; 346/101, 141

[56] References Cited

U.S. PATENT DOCUMENTS 3,387,081 6/1968 Kleinschmidt ..... 101/93.04 X
3,768,403 10/1973 Rose ..... 101/93.04
3,804,008 4/1974 Hoyer ..... 101/93.04

FOREIGN PATENT DOCUMENTS 167459 12/1981 Japan ..... 400/121

*Primary Examiner*—Paul T. Sewell
*Attorney, Agent, or Firm*—Robert E. Burns; Emmanuel J. Lobato; Bruce L. Adams

[57] ABSTRACT

A print head travelled lengthwise with respect to a cylindrical rotary drum provided on its outer periphery with a plurality of ridges extending parallel to the axis has two or more print hammers electromagnetically driven. The print hammers are arranged parallel to one another at a distance corresponding to a horizontal pitch of a dot matrix and are changeably driven with intervals which the corresponding ridge of the drum requires to move a vertical pitch of the dot matrix. Further, in order to avoid a bad influence of a nonuniformity of rotation of the drum to the printing quality, the print hammers have a plurality of bumps for forming dots on the respective striking surfaces and each of the ridges has a periphery surface of a width greater than a thickness of the print hammer.

14 Claims, 3 Drawing Figures

CROSS HAMMER DOT PRINTER

This invention is relates to a cross hammer dot printer.

There is known a cross hammer dot printer which comprises a cylindrical rotary drum having a plurality of ridges parallel to the axis on its outer periphery and a print head which travels in a direction transverse to the direction of advance of paper in front of the rotary drum. The print head has a single print hammer facing opposite to one of the ridges of the rotary drum in a substantially intersecting manner. Each of the ridges is positionable so as to face the print hammer upon rotation of the rotary drum. As the print hammer is electromagnetically driven, it impacts against the corresponding ridge and then a dot is formed at a position of intersection between the print hammer and the corresponding ridge. The corresponding ridge is displaceable to change the position of intersection relative to the print hammer in the direction of a column of a dot matrix upon rotation of the rotary drum, and at the same time the print hammer is displaceable to change the position of intersection relative to the corresponding ridge in the direction of row of the dot matrix upon travelling of the print head. During of rotation the rotary drum and travelling of the print head, the print hammer is selectively driven so that the desired characeters and so forth are formed on the paper. Such a known cross hammer dot printer having a single print hammer is inferior with respect to the printing speed in comparison with the other dot printer such as a wire printer. Further, since the positions of dots are decided by the position of intersection between the print hammer and the ridges, it is directly subject to irregularity in the arrangement of dots if the rotary drum undergoes a nonuniform rotation due to backlash of a gear train for driving the rotary drum and/or unbalance of an inertia of the rotary drum. Therefore, the known cross hammer dot printer is inferior to the other dot printer with respect to the printing quality also.

An object of the present invention is to provide a cross hammer dot printer capable of forming characters and so forth at a very high speed.

Another object of the present invention is to provide a cross hammer dot printer capable of forming characters and so forth with a good printing quality.

The invention is illustrated, merely by way of example, in the accompaning drawings in which.

Figure 1:
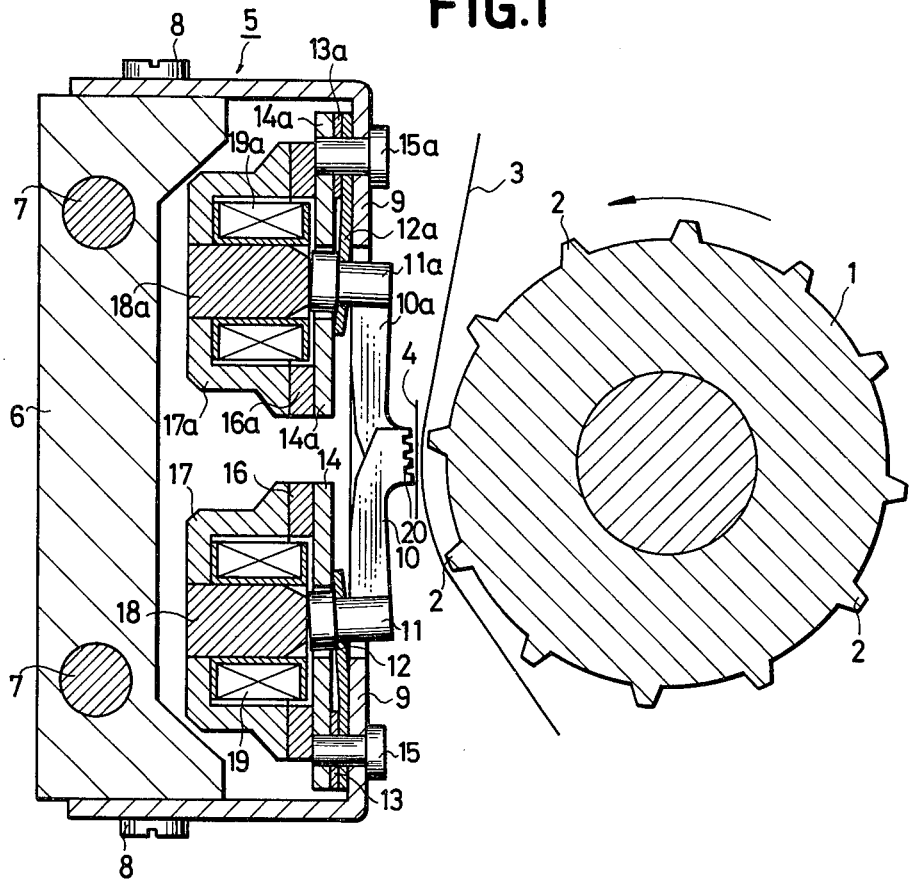
FIG. 1 is a cross sectional view of a cross hammer dot printer according to the present invention.

Referring to FIG. 1, a cylindrical rotary drum 1 which is driven to continuously rotate counterclockwise has a plurality of ridges 2 on the outer periphery thereof. The rotary drum 1 has a length longer than a width of a paper 3 and the ridges 2 are integrally formed so as to extend parallel to the axis of the drum over its total length. A print head 5 is disposed opposite to the rotary drum 1 via the paper 3 and an ink ribbon 4 and comprises a carriage 6 for travelling the print head 5 and which is slidably received on two guide shafts 7 and a carrier plate 9 secured to the carriage 6 by means of screws 8. In the case of the present embodiment, two print hammers 10, 10*a* are arranged adjacent parallel to each other on the carrier plate 9 and extend so as to substantially intersect one of the ridges 2 of the rotary drum 1. Free ends of the print hammers 10, 10*a* are located at a central position of the carriage 6 and the other ends are disposed at lower and upper positions respectively.

The electromagnetic driving devices for actuating the print hammer 10, 10*a* have the same configuration and thus only the device for the print hammer 10 will be described hereinafter. With respect to the device for the print hammer 10*a*, the corresponding part is indicated by using the same reference number with the small appendix character a in the drawings.

The end of the print hammer 10 is supported by a pin-shaped movable yoke 11 which is secured to a free end of a resilient arm plate 12. The arm plate 12 is fixed together with a spacer plate 13 and a front yoke 14 on the carrier plate 9 by means of a pin 15. The front yoke 14 has a center hole through which a rear portion of the movable yoke 11 passes. An annular permanent magnet 16 and a cap-shaped rear yoke 17 are fixed behind the front yoke 14. The yoke 17 has a post-like center yoke 18 extending toward the movable yoke 11 from its bottom and arround which a coil 19 is wound. The movable yoke 11 is magnetically attracted by the center yoke 18 so that the arm plate 12 is backwardly deformed against its own resilient force. As a driving current is supplied to the coil 19, a magnetic force of the center yoke 18 which is produced by virtue of a magnetic flux of the magnet 16 is canceled so that the movable yoke 11 is released from attraction by the yoke 17 and is moved forward by virtue of the resilient restoring force of the arm plate 12. Thus the print hammer 10 also moves forward and impacts the paper 3 and the ink ribbon 4 against one of the ridges 2 of the drum 1.

Figure 2:
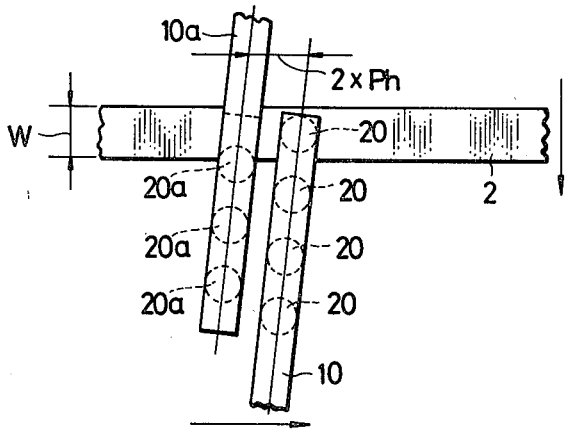
FIG. 2 shows a relation between print hammers of a print head and one of ridges of a rotary drum.

FIG. 2 shows a relation between the print hammers 10 and 10*a* and a corresponding ridge 2 of the rotary drum 1. Upon travelling of the head 5, the print hammers 10 and 10*a* are displaceable relative to the corresponding ridge 2 in a direction of travelling of the head 5, i.e. in a horizontal direction. At the same time, the corresponding ridge 2 is displaceable relative to the print hammers 10 and 10*a* in a vertical direction upon rotation of the rotary drum 1. Due to such a relative motion between the corresponding ridge 2 and the print hammers 10 and 10*a*, in order to form dots in the direction of a column of the dot-matrix in a vertical line, each of the print hammers 10 and 10*a* is inclined at a predetermined angle with respect to the normal as shown in FIG. 2. The print hammers 10 and 10*a* may be provided on their striking surfaces with a plurality of bumps 20 and 20*a* integrally formed therewith for impacting against the corresponding ridge 2.

Figure 3:
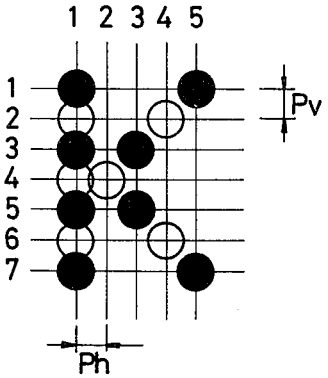
FIG. 3 illustrates, as an example, a dot-matrix character "K" which is formed by the cross hammer dot printer of the invention.

FIG. 3 shows, by way of example, a dot-matrix character "K" which is formed by the printer of the invention. The bumps 20 and 20*a* are respectively arranged at equal distances corresponding to twice the vertical pitch Pv of the dot matrix. Namely, the bumps 20 of the print hammer 10 are positioned on the first, third, fifth and seventh rows of the dot-matrix and the bumps 20*a* of the print hammer 10*a* are positioned on the second, fourth and sixth rows of the dot-matrix. Further, the print hammers 10 and 10*a* of the embodiment are located parallel to each other at a horizontal distance corresponding to twice the horizontal pitch Ph of the dot-matrix and each of the ridges 2 has a periphery impact surface of a width W greater than a predetermined size which, in the case of the embodiment, is greater than the width of the print hammers 10 and 10*a* or greater than the diameter of the bumps 20 or 20*a*.

Printing operation for forming the character "K" as shown in FIG. 3 will be set forth hereinafter. In FIG. 3, ● are dots formed by the print hammer 10, and ○ are dots formed by the print hammer 10*a*. Supposing now the leading print hammer 10 is positioned at a position corresponding to the third column of the dot-matrix, the print hammer 10*a* would be positioned at the position corresponding to the first column. Then, as the ridge 2 comes to a position corresponding to the second row, the print hammer 10*a* is driven so that a dot is formed at a position corresponding to the first column second row. In succession, as the ridge 2 is displaced to a position corresponding to the third row, the print hammer 10 is driven so as to form a dot at a position corresponding to the third column third row, and as the ridge 2 is displaced to a position corresponding to the fourth row the print hammer 10*a* is driven so as to form a dot at a position corresponding to the first column fourth row. In this way, the print hammers 10 and 10*a* are alternately driven at intervals which the corresponding ridge 2 requires to move a vertical pitch Pv of the dot-matrix and the print hammers coact together to jointly form the desired characters or the like. In the case of printer having twin hammers 10 and 10*a* such as the presently disclosed embodiment, the print hammers 10 and 10*a* serve to form dots at odd and even numbered rows respectively, and the print hammer 10*a* forms dots between dots which are formed by the leading print hammer 10.

The rotary drum 1 may rotate somewhat nonuniformly due to an unbalance of its inertia and/or backlash between the driving gears (not shown). However, since the print hammer 10 and 10*a* of this embodiment have the bumps 20 and 20*a*, the positions of the dots of each rows are unconditionally decided by the bumps 20 and 20*a*. Therefore, when forming, for example, a horizontal line, the dots, in particular the dots of the direction of each row, are in line in an orderly way even though there occurs a somewhat nonuniformity in rotation of the drum 1.

The invention is not limited to the disclosed embodiment and can be suitably modified. For example, the bumps of the print hammers can have a rectangular or square shape. Further, depending on circumstances, the bumps may be eliminated altogether. In such a case, each of the ridges should have a periphery surface of a width substantially equal to a thickness of the print hammer. Still further, the distance between the print hammers can be decided to any value if it is a multiple of the horizontal pitch of the dot-matrix, and the number of print hammers can be changed to three or more if desired. In addition, with respect to the driving means for the print hammers, it is possible to use a moving coil type device instead of a fixed coil type device as in the disclosed embodiment.

According to the cross hammer dot printer of the invention as described above, since the print head has two or more print hammers changeably driven at intervals which the corresponding ridge requires to move a vertical pitch of the dot-matrix, it is capable of forming the desired characters and so forth at a very high speed.

Further, since the print hammers are changeably driven without being driven at the same time, a peak of the driving currents is the same in comparison with the conventional cross hammer dot printer having a single print hammer and there is no requirement to use a large power supply device. In addition, in the case that the print hammers are provided on the striking surfaces thereof with a plurality of bumps which are arranged at positions corresponding to the rows of the dot-matrix, a printing quality is very good. Further, since high accuracy is not required in controlling the rotation of the rotary drum, the manufacturing cost can be reduced and the printer can be easily produced.

What is claimed is:

1. A cross hammer dot printer comprising: a print head carrying thereon two or more electromagnetically driven print hammers and being displaceable lengthwise with respect to a cylindrical rotary drum disposed in spaced relation therefrom, said rotary drum being provided on the outer periphery thereof with a plurality of ridges extending parallel to the axis of rotation thereof, each of said ridges being positionable so as to intersect said print hammers during rotation of the rotary drum to enable the printing of a dot matrix, means mounting said print hammers parallel to and spaced from one another at a distance corresponding to a multiple of a horizontal pitch of the dot matrix, and means for changeably driving said print hammers at intervals corresponding to the time required for the corresponding ridge to move a vertical pitch of the dot matrix during rotation of the rotary drum.

2. A cross hammer dot printer as claimed in claim 1 in which each of said print hammers extends alternately from lower and upper positions of said print head so as to direct a striking surface of the free end thereof toward center.

3. A cross hammer dot printer comprising: a print head carrying thereon two or more electromagnetically driven print hammers and being displaceable lengthwise with respect to a cylindrical rotary drum disposed in spaced relation therefrom, said rotary drum being provided on the outer periphery thereof with a plurality of ridges extending parallel to the axis of rotation thereof, each of said ridges being positionable so as to intersect said print hammers during rotation of the rotary drum to enable the printing of a dot matrix, means mounting said print hammers parallel to and spaced from one another at a distance corresponding to a multiple of a horizontal pitch of the dot matrix, means for changeably driving said print hammers at intervals corresponding to the time required for the corresponding ridge to move a vertical pitch of the dot matrix during rotation of the rotary drum, and each of said print hammers having a plurality of bumps for forming dots on a striking surface of the free end thereof.

4. A cross hammer dot printer as claimed in claim 3 in which each of said print hammers extends alternately from lower and upper positions of said print head so as to direct a striking surface of the free end thereof having said bumps toward center.

5. A cross hammer dot printer as claimed in claim 3 or 4 in which said bumps are relatively out of position between said print hammers and are positioned at locations corresponding to rows of the dot matrix.

6. A cross hammer dot printer as claimed in claim 3 or 4, in which each of said ridges has a periphery surface of a width greater than a thickness of said print hammer.

7. In a cross hammer dot printer for printing dot-matrix characters comprised of columns and rows of dots: a rotationally driven drum having a plurality of circumferentially spaced apart ridges extending parallel to one another and parallel to the axis of rotation of the drum; a print head displaceable lengthwise with respect to the drum in spaced relation therefrom; and means including a plurality of electromagnetically actuatable print hammers mounted on the print head in spaced relation with respect to the direction of displacement thereof and coacting together to jointly effect the printing of one dot-matrix character in response to selective actuation of the print hammers such that the actuated print hammers impact the drum ridges during rotation of the drum to cause the printing of one dot of the dot-matrix character for each print hammer actuation.

8. A cross hammer dot printer according to claim 7; wherein the means including a plurality of electromagnetically actuatable print hammers comprises means mounting alternate ones of the print hammers so as to extend downwardly from an upper part of the print head and alternate ones of the print hammers so as to extend upwardly from a lower part of the print head.

9. A cross hammer dot printer according to claim 8; wherein the print hammers extend parallel to one another and are spaced apart from one another a distance corresponding to a multiple of the column pitch of the dot-matrix.

10. A cross hammer dot printer according to claim 8; wherein the impact surface of the drum ridges has a greater width than that of the print hammers.

11. A cross hammer dot printer according to claim 8; wherein the print hammers extend parallel to one another and are inclined a predetermined angle with respect to the normal.

12. A cross hammer dot printer according to claim 7; wherein the print hammers extend parallel to one another and are spaced apart from one another a distance corresponding to a multiple of the column pitch of the dot-matrix.

13. A cross hammer dot printer according to claim 7; wherein the impact surface of the drum ridges has a greater width than that of the print hammers.

14. A cross hammer dot printer according to claim 7; wherein the print hammers extend parallel to one another and are inclined a predetermined angle with respect to the normal.

* * * * *